US012680224B2

(12) United States Patent
Yan

(10) Patent No.: US 12,680,224 B2
(45) Date of Patent: Jul. 14, 2026

(54) ANTI-SCALD TRICKLING CLOTHES STEAMER

(71) Applicant: NINGBO KAIBO GROUP CO., LTD., Ningbo (CN)

(72) Inventor: Jie bo Yan, Ningbo (CN)

(73) Assignee: NINGBO KAIBO GROUP CO., LTD., Ningbo (CN)

( * ) Notice: Subject to any disclaimer, the term of this patent is extended or adjusted under 35 U.S.C. 154(b) by 37 days.

(21) Appl. No.: 18/678,951

(22) Filed: May 30, 2024

(65) Prior Publication Data

US 2025/0277335 A1 Sep. 4, 2025

(30) Foreign Application Priority Data

Mar. 4, 2024 (CN) ..... 202410241878.8
Mar. 28, 2024 (CN) ..... 202410369803.8

(51) Int. Cl.

*D06F 75/18* (2006.01)
*D06F 75/20* (2006.01)
*D06F 75/24* (2006.01)
*D06F 75/34* (2006.01)

(52) U.S. Cl.

CPC ..... *D06F 75/18* (2013.01); *D06F 75/20* (2013.01); *D06F 75/24* (2013.01); *D06F 75/34* (2013.01)

(58) Field of Classification Search

CPC ..... D06F 75/18; D06F 75/20; D06F 75/24; D06F 75/34

See application file for complete search history.

(56) References Cited

U.S. PATENT DOCUMENTS

2014/0013636 A1* 1/2014 Laudahn ..... D06F 75/14 38/77.83
2025/0188674 A1* 6/2025 Ren ..... D06F 75/24

FOREIGN PATENT DOCUMENTS

CN 106801324 A * 6/2017 ..... D06F 73/00
CN 209412565 U * 9/2019
WO WO-2020211774 A1 * 10/2020 ..... D06F 73/00

OTHER PUBLICATIONS

Machine translation CN106801324 (Year: 2017).*
Machine translation CN209412565 (Year: 2019).*

* cited by examiner

*Primary Examiner* — Uyen T Nguyen
(74) *Attorney, Agent, or Firm* — MUNCY, GEISSLER, OLDS & LOWE, P.C.

(57) ABSTRACT

An anti-scald trickling clothes steamer belongs to ironing devices. All water in a water tank of existing electric kettle clothes steamers is heated, so scalding is likely to be caused. In the invention, an atomizing device is arranged in a main body and connected with a water tank, and receives water automatically trickling from the water tank by means of a difference in water level, and when the atomizing device heats water to generate steam, only water automatically trickling from the water tank rather than all water in the water tank is heated, such that scalding caused splashing of boiling water are voided. Even if water flows out of the water tank when the clothes steamer falls, because the water in the water tank is not heated and is at normal temperature, scalding will not be caused, either.

17 Claims, 5 Drawing Sheets

ANTI-SCALD TRICKLING CLOTHES STEAMER

BACKGROUND OF THE INVENTION

1. Technical Field

The invention belongs to ironing devices, and particularly relates to an anti-scald trickling clothes steamer.

2. Description of Related Art

Electric kettle clothes steamers, as steam ironing devices, are provided with a heating device mounted in or close to a water tank, all the water in which will be heated to generate steam. Such electric kettle clothes steamers have potential safety hazards: in a case where the water tank is full of water, boiling water will splash when water in the water tank is heated to the boiling point, thus causing scalding; and when the clothes steamers fall, water will flow out of the water tank, and scalding may also be caused if water in the water tank is at a high temperature.

BRIEF SUMMARY OF THE INVENTION

The technical issue and task to be addressed by the invention is to provide an anti-scald trickling clothes steamer to overcome the defect of scalding caused by heating of all water in the water tank of existing electric kettle clothes steamers.

To fulfill the above purpose, the anti-scald trickling clothes steamer provided by the invention comprises:

- a main body placed upright on a platform;
- a water tank arranged on the main body and forming a combination together with the main body, such that the water tank and the main body can be held as a whole when the anti-scald trickling clothes steamer is used for ironing;
- an atomizing device located in the main body, connected with the water tank, receiving water automatically trickling from the water tank by means of a difference in water level, and used for converting the water into steam;
- a steam pipe connected with the atomizing device, used for discharging steam generated by the atomizing device, arranged on the main body and extending upwards from the atomizing device to ensure that an outlet of the steam pipe is higher than the atomizing device, such that the anti-scald trickling clothes steamer is suitable for ironing clothes hanging up and steam is prevented from spraying out via the outlet of the steam pipe; and
- a handle arranged on the combination and used for holding the trickling clothes steamer, such that the whole trickling clothes steamer can be carried when used for ironing.

According to the trickling clothes steamer, when the atomizing device heats water to generate steam, only water automatically trickling from the water tank rather than all water in the water tank is heated, such that scalding caused splashing of boiling water are voided. Even if water flows out of the water tank when the clothes steamer falls, because the water in the water tank is not heated and is at normal temperature, scalding will not be caused, either.

According to the trickling clothes steamer, the atomizing device receives water automatically trickling from the water tank by means of the difference in water level and converts the water into steam without a water delivery device such as a water pump, such that the trickling clothes steamer is simple in structure and low in manufacturing cost and failure rate.

In addition, when the anti-scald trickling clothes steamer falls, the water level in the water tank will change, and the difference in water level promoting water to automatically trickle from the water tank to the atomizing device will decrease to allow no water or less water to automatically trickle from the water tank to the atomizing device to stop or weaken steam generation, thus avoiding scalding caused by steam.

Preferably, the handle and the outlet of the steam pipe are located on two opposite sides of the trickling clothes steamer separately. In this way, a hand holding the handle can be kept away from the outlet of the steam pipe to be protected against scalding.

Preferably, a controllable water valve is arranged between the water tank and the atomizing device, and the atomizing device receives water automatically trickling from the water tank via the controllable water valve. When the controllable water valve is opened, water stored in the water tank is allowed to automatically trickle to the atomizing device. In this way, the time water is delivered from the water tank to the atomizing device can be controlled, for example, water is delivered from the water tank to the atomizing device when the atomizing device is preheated to a set temperature and will not be delivered to the atomizing device before the atomizing device is preheated to the set temperature, such that the situation where the quality of steam is reduced (for example, tiny water drops are contained in steam spraying out) due to the retention of cold water in the atomizing device is avoided.

Preferably, the controllable water valve comprises a water delivery hole, a valve plug and a bimetal sheet, the valve plug is arranged at the water delivery hole, and the bimetal sheet is arranged next to the valve plug and configured to deform with the change of a degree of being heated to promote the valve plug to change its position to open or close the water delivery hole. In this way, the bimetal sheet can automatically open or close the water delivery hole according to the degree of being heated. When the anti-scald trickling clothes steamer is used for ironing, the water delivery hole is opened to deliver water; and when the anti-scald trickling clothes steamer is not used, the water delivery hole is closed to stop water delivery.

Preferably, the valve plug is provided with a shaft and a sealing cover connected with the shaft, the shaft is located at the water delivery hole, the sealing cover is located at an opening of the water delivery hole, and the sealing cover is able to cover the opening of the water delivery hole to close the water delivery hole and leave the opening of the water delivery hole to open the water delivery hole. In this way, it is ensured that the valve plug is located at a position matching the water delivery hole and can smoothly open or close the water delivery hole as needed.

Preferably, the bimetal sheet is configured to receive heat from the atomizing device and open the water delivery hole when the degree of being heated is increased. In this way, the working state of the clothe steamer can be determined. For example, when the clothes steamer is started, the atomizing device generally needs to be preheated, and water is delivered to the atomizing device when the atomizing device is preheated to a set temperature.

Preferably, the controllable water valve comprises a wall, the water delivery hole is formed in the wall, a bottom cover is arranged on a lower side of the wall, the valve plug is arranged on the bottom cover through an elastic portion and seals the water delivery hole by means of the elastic portion, and the bimetal sheet is configured to overcome an elastic force from the elastic portion to open the water delivery hole. In this way, the water delivery hole can be reliably closed by means of the valve plug to prevent accidental water leaking, and when the clothes steamer is used for ironing, the water delivery hole is opened under the action of the bimetal sheet. Thus, the clothes steamer can work intelligently to avoid misoperation.

Preferably, a channel is formed between the wall and the bottom cover, and the channel is connected with the water delivery hole and the atomizing device. In this way, the atomizing device can be kept away from the water tank, water automatically trickling from the water tank can be controlled, and heat transferred from the atomizing device to the water tank is reduced.

Preferably, a controllable flow control lever is configured for the channel to control the water delivery rate.

Preferably, a bottom wall of the water tank functions as the wall. In this way, the structure can be simplified.

Preferably, the water tank is fixed in the main body, a water filling hole is formed in a top of the water tank, and a water tank cover is arranged over the water filling hole. In this way, the clothes steamer is configured as a non-detachable structure.

Preferably, to prevent a negative pressure from being formed in the water tank when water from the water tank is delivered via the controllable water valve, which may otherwise hinder water delivery via the controllable water valve in the vertical direction, a balance hole is formed in the water tank cover to supplement air into the water tank when water from the water tank is delivered via the controllable water valve.

Preferably, a sealing element is arranged at the water filling hole of the water tank, and the when covering the water filling hole, the water tank cover is in contact with the sealing element to prevent water from leaking via the water filling hole. In this way, water can be prevented from flowing out via the water inlet when the water tank falls.

In one embodiment, the wall is arranged on the main body, a water outlet connected with the water delivery hole is formed in a bottom of the water tank, and the water outlet is configured to be opened when connected with the water delivery hole and be closed when separated from the water delivery hole. In this way, the structure of the water tank can be expanded, allowing the water tank to be designed more flexibly.

In one embodiment, the water tank is detachably arranged on the main body. In this way, the water tank can be detached from the main body to facilitate water filling, and the burden of a hand holding the clothes steamer and the risk that water enters the main body can be reduced when water is filled in the trickling clothes steamer.

To ensure that the water tank and main body can be combined to be held easily, the water tank and the body form a combination by means of a combining mechanism, and the combining mechanism comprises a magnetic structure and/or a lock structure.

In different embodiments, the handle is arranged on the main body or the water tank.

Preferably, the main body is provided with a nozzle located at a top of the main body, and the outlet of the steam pipe is extended to the nozzle. In this way, the steam discharge position and direction can be configured reasonably.

Preferably, a steam panel is arranged at the outlet of the steam pipe, and a steam outlet is formed in the steam panel. In this way, steam discharge can be controlled to fulfill a good ironing effect.

In the invention, the atomizing device is arranged in the main body and connected with the water tank, and receives water automatically trickling from the water tank by means of the difference in water level, and when the atomizing device heats water to generate steam, only water automatically trickling from the water tank rather than all water in the water tank is heated, such that scalding caused splashing of boiling water are voided. Even if water flows out of the water tank when the clothes steamer falls, because the water in the water tank is not heated and is at normal temperature, scalding will not be caused, either.

When the trickling clothes steamer provided by the invention falls, the water level in the water tank will change, and the difference in water level promoting water to automatically trickle from the water tank to the atomizing device will decrease to allow no water or less water to automatically trickle from the water tank to the atomizing device to stop or weaken steam generation, thus avoiding scalding caused by steam.

In the invention, the steam pipe is arranged on the main body and extends upwards from the atomizing device to ensure that the outlet of the steam pipe is higher than the atomizing device, such that the anti-scald trickling clothes steamer is suitable for ironing clothes hanging up and steam is prevented from spraying out via the outlet of the steam pipe In the invention, the water tank can be configured flexibly, and specifically, the water tank can be fixed in the main body and can also be detachably arranged on the main body. In addition, the handle can be arranged on the main body or the water tank as needed, and particularly, when the water tank is detachably arranged on the main body, the handle is arranged on the water tank, and thus can be held to operate the trickling clothes steamer and can also be held to detach the water tank from the main body.

In the invention, the controllable water valve is arranged between the water tank and the atomizing device, and the atomizing device receives water automatically trickling from the water tank via the controllable water valve. When the controllable water valve is opened, water stored in the water tank is allowed to automatically trickle to the atomizing device. In this way, the time water is delivered from the water tank to the atomizing device can be controlled, for example, water is delivered from the water tank to the atomizing device when the atomizing device is preheated to a set temperature and will not be delivered to the atomizing device before the atomizing device is preheated to the set temperature, such that the situation where the quality of steam is reduced (for example, tiny water drops are contained in steam spraying out) due to the retention of cold water in the atomizing device is avoided.

REFERENCE SIGNS

100, main body; 101, handle; 102, nozzle; 103, base; 104, retaining position; 105, hook portion;

200, water tank; 201, water filling hole; 202, wall; 203, sealing element; 204, water outlet; 205, valve ball; 206, third spring; 207, magnet; 208, hook; 209, push button; 210, slope; 211, first spring; 212, second spring;

300, controllable water valve; 301, water delivery hole; 302, valve plug; 303, bimetal sheet; 304, shaft; 305, sealing cover; 306, bottom cover; 307, elastic portion; 308, channel; 309, flow control lever; 310, tube; 311, slot;

400, water tank cover; 401, balance hole;

500, atomizing device; 501, main part; 502, electric heating tube; 503, temperature controller;

600, steam pipe; 601, outlet;

700, steam panel; 701, steam outlet.

DETAILED DESCRIPTION OF THE INVENTION

To gain a better understanding of the purposes, technical solutions and advantages of the invention, the technical solutions in the embodiments of the invention will be clearly and completely described below in conjunction with the accompanying drawings of the embodiments. Obviously, the embodiments in the following description are merely illustrative ones, and are not all possible ones of the invention. All other embodiments obtained by those ordinarily skilled in the art based on the following ones without creative labor should also fall within the protection scope of the invention.

Terms "comprise" and "provided with" and any variants thereof in the description and claims of the invention are intended to indicate non-exclusive inclusion. For example, a method or product comprising a series of technical features is not necessarily limited to the technical features clearly listed, and may also comprise other technical features that are not clearly listed and may be included in the method or product.

The invention will be introduced in detail below in conjunction with specific embodiments and accompanying drawings.

Embodiment 1

Figure 1:
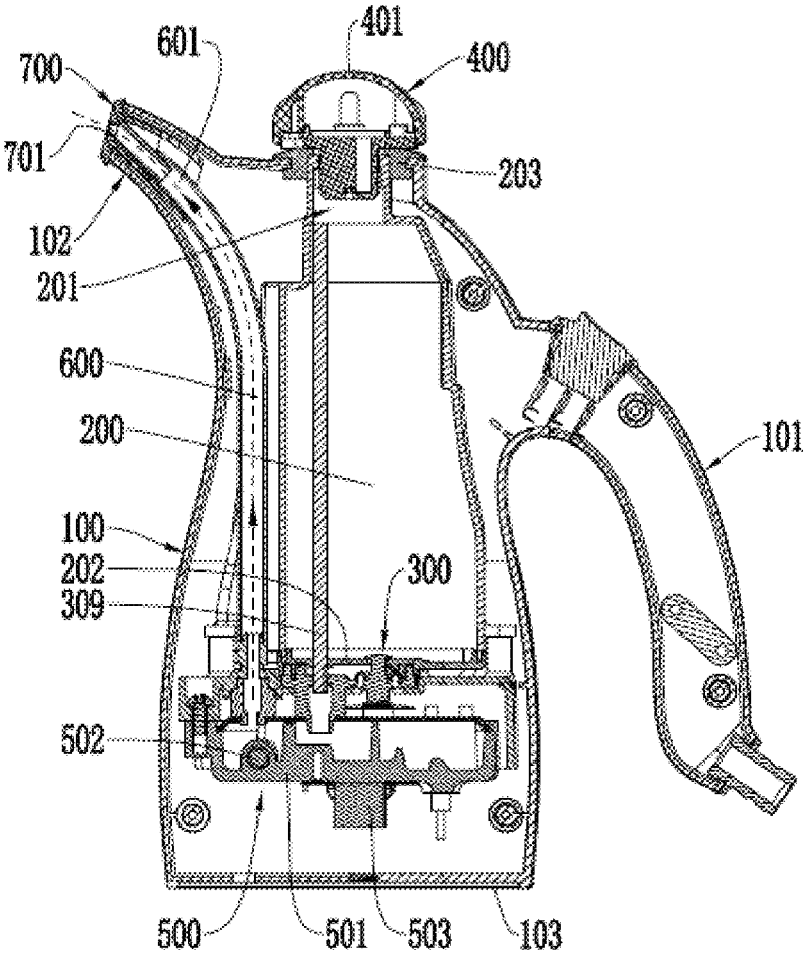
FIG. 1 is a schematic sectional structural view of an anti-scald trickling clothes steamer according to Embodiment 1 of the invention.

As shown in FIG. 1, this embodiment provides an anti-scald trickling clothes steamer, comprising a main body 100, a water tank 200, a controllable water valve 300, a water tank cover 400, an atomizing device 500 and a steam pipe 600.

The main body 100 is provided with a base 103, a handle 101 and a nozzle 102, wherein the base 103 allows the main body to be upright placed on a platform, and the handle 101 and the nozzle 101 together with an outlet 601 of the steam pipe are located on left and right sides of the trickling clothes steamer separately. In this way, the whole main body is shaped like a kettle. Users can operate the trickling clothes steamer by holding the handle.

The water tank 200 is located in the main body 100, a water filling hole 201 is formed in the top of the water tank 200 and located at an upper end of the main body 1000, a sealing element 203 is arranged at the water filling hole of the water tank, and a controllable water valve 300 is arranged at the bottom of the water tank 200.

The controllable water valve 300 comprises a water delivery hole 301, a valve plug 302 and a bimetal sheet 303.

The water delivery hole 301 is formed in a wall 202, and in this embodiment, a bottom wall of the water tank functions as the wall 202.

Figure 2:
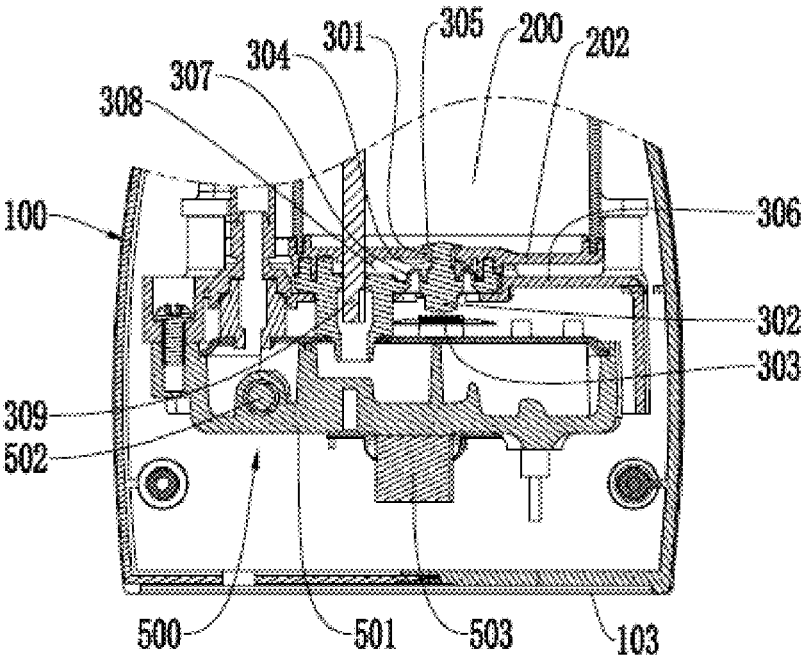
FIG. 2 is a schematic view in a case where a water delivery hole in FIG. 1 is closed by a valve plug.
Figure 3:
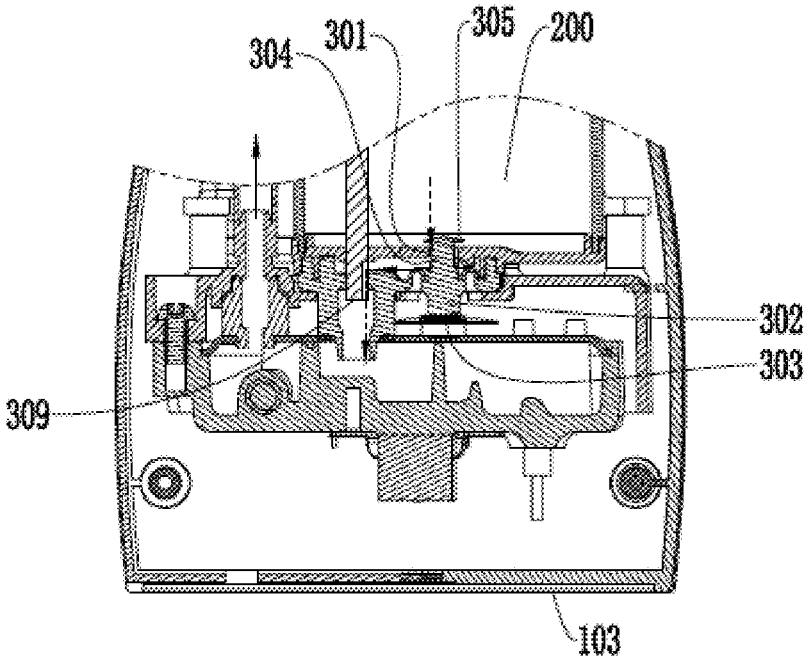
FIG. 3 is a schematic view in a case where the water delivery hole in FIG. 1 is opened by the valve plug.

A bottom cover 306 is arranged on a lower side of the wall 202, and the valve plug 302 is arranged on the bottom cover 306 through an elastic portion 307 and seals the water delivery hole 301 by means of the elastic portion. Wherein, the elastic portion 307 is integrated with the bottom cover 306 and the valve plug 302, such that the bottom cover, the valve plug and the elastic portion are preferably made from an elastic material such as silicone. The valve plug 302 is provided with a shaft 304 and a sealing cover 305 connected with the shaft 304. The shaft 304 is located at the water delivery hole 301 and connected with the elastic portion 307. The sealing cover 305 is located at an upper opening of the water delivery hole 301. As shown in FIG. 2, the sealing cover 305 covers the upper opening of the water delivery hole 301 to close the water delivery hole; and as shown in FIG. 3, the sealing cover 305 moves upwards to leave the upper opening of the water delivery hole 301 to open the water delivery hole. Further, a channel 306 is formed between the wall 202 and the bottom cover 306 and connected with the water delivery hole 301 and the atomizing device 500. A controllable flow control lever 309 is configured for the channel 308, and a variable-flow passage is formed in a length direction of the flow control lever 309, such that the flow rate can be controlled by adjusting the position of the flow control lever in the length direction. The flow control lever may be driven by rotation of a rotary knob to move in the length direction to be adjusted.

The bimetal sheet 303 is formed by stacking together two metal sheets with different expansion coefficients. When heated synchronously, the two metal sheets will expand to different degrees to promote the bimetal sheet to deform towards one side. As shown, the bimetal sheet 303 is located below the valve plug 302 and is next to the atomizing device 500, such that the atomizing device can receive heat from the bimetal sheet. At normal temperature, the sealing cover 305, as shown in FIG. 2, covers the upper opening of the water delivery hole 201 by means of an elastic force from the elastic portion 307 to close the water delivery hole. When the anti-scald trickling clothes steamer works, with the rise of the temperature of the atomizing device 500, the bimetal sheet 303 will deform upwards to overcome the elastic force from the elastic portion 307 to eject the valve plug 303, at this moment, the sealing cover 305, as shown in FIG. 3, moves upwards to leave the upper opening of the water delivery hole 301 to open the water delivery hole, and water trickles automatically from the water tank 200 via the water delivery hole 301 based on a difference in water level and then flows into the atomizing device 500 via the channel 308. The dotted line with an arrow in FIG. 3 indicates the path of the water flow. When the water flow passes through the channel 308, the flow rate of water is controlled by adjusting the position of the flow control lever 309 in the length direction. When the anti-scald trickling clothes steamer stops working, the temperature of the atomizing device 500 will drop, the temperature of the bimetal sheet 303 will drop accordingly, and the valve plug 302 restores to the state shown in FIG. 2 to close the water delivery hole 301.

The water tank cover 400 is arranged over the water filling hole 201 by clamping or threaded connection and seals the water tank by means of the sealing element 203. A balance hole 401 is formed in the water tank cover 400.

The atomizing device 500 is configured as a boiler structure, arranged in the main body 100 and located below the water tank 200. An electric heating tube 502 is buried in a main part 501 of the atomizing device 500. When power is supplied to the electric heating tube, the electric heating tube will generate heat to heat the whole atomizing device. The atomizing device 500 is connected with the controllable water valve 300 to receive water from the water tank. To control the temperature of the atomizing device, a temperature controller 503 may be configured for the atomizing device.

The steam pipe 600 is connected with the atomizing device 500 and used for discharging steam generated by the atomizing device, and the dotted line with an arrow in FIG. 1 indicates the path along which the steam is discharged. The outlet 601 of the steam pipe 600 is extended to the nozzle 102. Because the handle and the nozzle are located on the left and right sides separately and the handle 101 and the outlet 601 of the steam pipe are also located on two opposite sides of the main body separately, a hand holding the handle will not be scalded by steam spraying out via the outlet 601 of the steam pipe. In addition, the water outlet 601 of the steam pipe and the wafter filling hole 201 of the water tank are located at the same altitude and are higher than the atomizing device 500. Moreover, a steam panel 700 is arranged at the water outlet 601 of the steam pipe, and a steam outlet is formed in the steam panel 700.

According to the atomizing device, in a case where water is stored in the water tank, at normal temperature, the sealing cover 305, as shown in FIG. 2, covers the upper opening of the water delivery hole 301 by means of an elastic force from the elastic portion 307, and water will not be delivered from the water tank to the atomizing device. When the anti-scald trickling clothes steamer works, the atomizing device is preheated first, the bimetal sheet 303 will deform upwards with the rise of the temperature of the atomizing device to overcome the elastic force from the elastic portion 307 so as to eject the valve plug 302, at this moment, the sealing cover 305, as shown in FIG. 3, will move upwards to leave the upper opening of the water delivery hole 301 to open the water delivery hole, and water flows out of the water tank via the water delivery hole 301 and then flows into the atomizing device 500 via the channel 308. The water delivery hole may be opened at a moment the temperature of the atomizing device reaches a water atomizing temperature, such that water dripping can be avoided. As shown, the outlet 601 of the steam pipe is higher than the atomizing device 500, such that even if the water delivery hole is opened before the temperature of the atomizing device reaches the atomizing temperature to allow a small amount of water to enter the atomizing device, the small amount of water will not flow out via the outlet of the steam pipe and will be atomized later with the further rise of the temperature of the atomizing device.

According to the clothes steamer, when the atomizing device heats water to generate steam, only water delivered from the water tank rather than all water in the water tank will be heated, such that scalding caused by splashing of boiling water are avoided; and even if water flows out of the water tank when the clothes steamer falls, because water in the water tank is not heated and is at normal temperature, scalding will not be caused, either. The clothes steamer is high in safety, easy to operate, simple and reasonable in structure, and reliable in life.

pump, thus being low in manufacturing cost and capable of saving energy during operation.

Embodiment 2

As shown in FIG. 4-FIG. 7, this embodiment provides an anti-scald trickling clothes steamer, which is different from the anti-scald trickling clothes steamer in Embodiment 1 mainly in the configuration of the water tank. To avoid unnecessary details, only the difference is detailed below.

Different from Embodiment 1 where the water tank is fixed in the main body to form a combination, in this embodiment, the water tank 200 is detachably arranged on the main body 100. In addition, the handle 101 is arranged on the water tank 200, and the handle 101 and the outlet 601 of the steam pipe are located on two opposite sides of the trickling clothes steamer separately.

Figure 4:
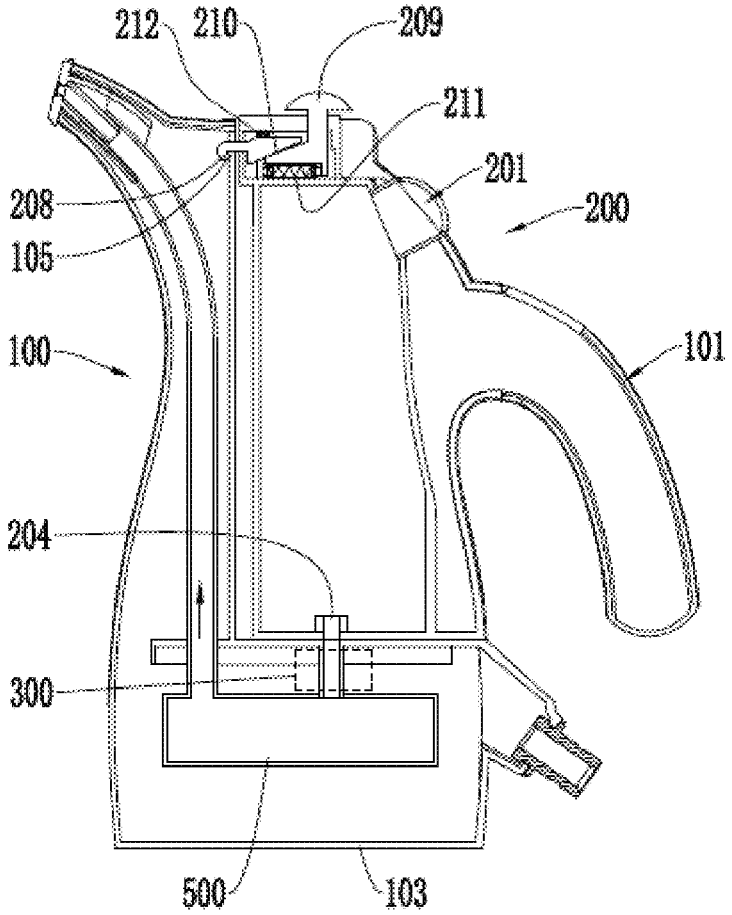
FIG. 4 is a schematic sectional structural view of an anti-scald trickling clothes steamer according to Embodiment 2 of the invention.

Specifically, a retaining position 104 is arranged on the main body 100, and as shown in FIG. 4, the water tank 200 is placed at the retaining position 101 to fulfill the form shown in FIG. 1.

Figure 5:
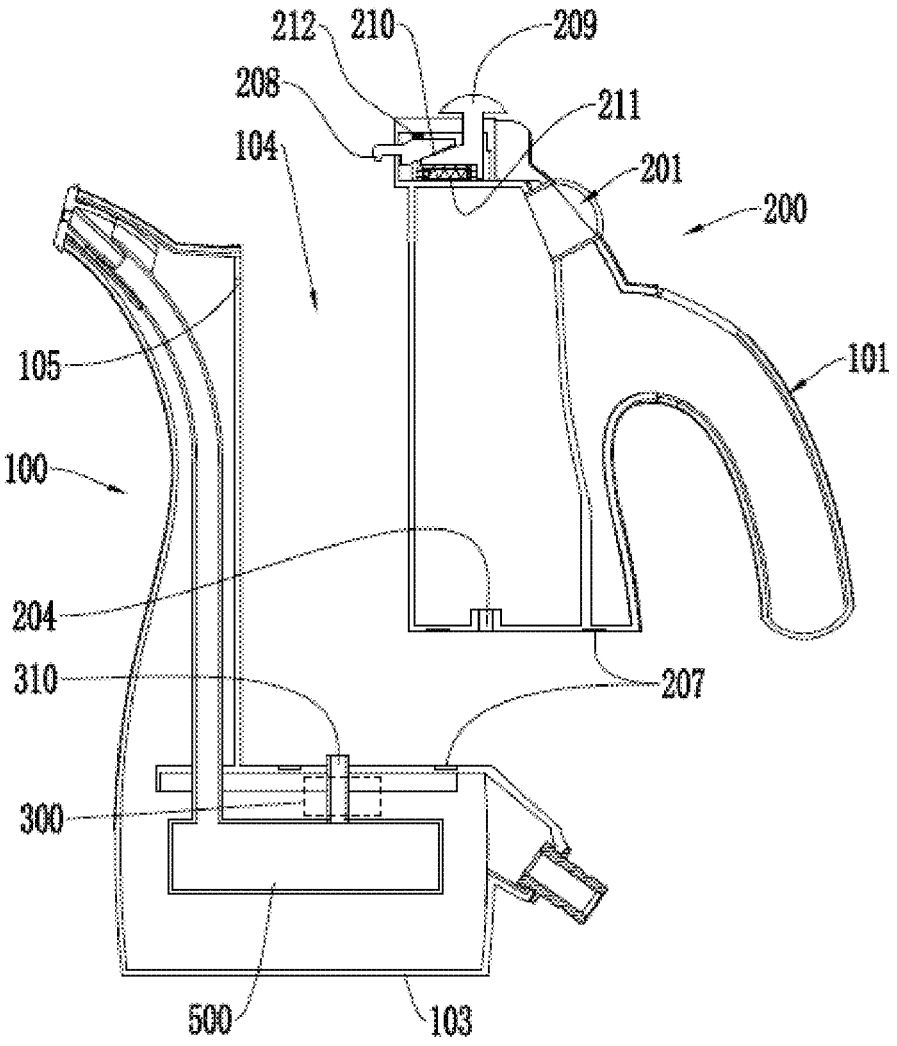
FIG. 5 is a schematic view in a case where a water tank and a main body of the trickling clothes steamer in FIG. 4 are separated.

To combine the water tank and the main body, a combining mechanism is arranged to allow the water tank 200 and the main body 100 to form a combination. According to the combining mechanism, the water tank can be combined with the main body as shown in FIG. 4 or be separated from the main body as shown in FIG. 5. As shown in FIG. 4-5, the combining mechanism comprises a magnetic structure and a lock structure. The magnetic structure, as shown in FIG. 5, comprises corresponding magnets 207 which are arranged at the retaining position 104 and the bottom of the water tank, and when the water tank is placed at the retaining position, the water tank and the main body are magnetically combined by means of the magnets. In addition, the lock structure comprises a hook portion 105 arranged at an upper end of the main body 100, as well as a hook 208 and a push button 209 which are arranged at the top of the water tank 200, and the hook 208 fits the push button 209 by means of a slope 210. As shown in FIG. 4, in a natural state, the push button 209 is maintained at a position on the right under the action of an elastic force from a first spring 211, and the hook 208 hooks the hook portion 105, such that the water tank and the main body are prevented from being separated from each other in the left-right direction. To ensure that the hook can hook the hook portion, a second spring 212 is arranged on the hook to apply a downward elastic force to the hook so as to prevent the hook from being separated from the hook portion. The magnetic structure and the lock structure work together to reliably combine the water tank and the main body into the combination, such that users can operate the trickling clothes steamer by holding the handle to fulfill the same using effect as the trickling clothes steamer shown in FIG. 1.

When pushed leftwards from the state shown in FIG. 4, the push button 209 overcomes the elastic force from the first spring 211 and the elastic force from the second spring 212 to lift the hook 209 by means of the slope 210, and the hook 208 is separated from the hook portion 105, such that the water tank can be detached from the main body. After the water tank is detached from the main body, water can be filled into the water tank more easily.

Under the enlightenment of the magnetic structure and the lock structure, the water tank and the main body can still be reliably combined by replacing the lock structure with another magnetic structure or replacing the magnetic structure with another lock structure.

In this embodiment, because the water tank is detachably arranged on the main body, the wall is arranged on the main body, which means that the controllable water valve 300 in Embodiment 1 is completely arranged on the main body 100, as indicated by the dashed box in FIG. 4 and FIG. 5.

Figure 6:
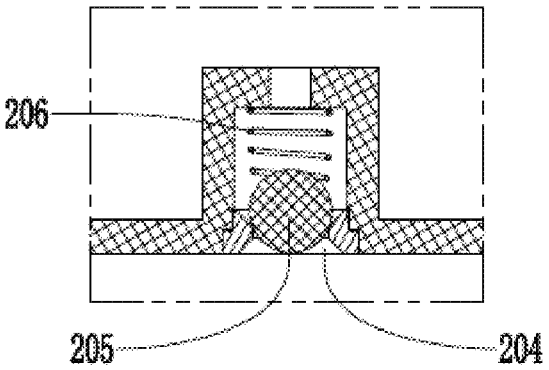
FIG. 6 is a schematic view of a water outlet in Embodiment 2.
Figure 7:
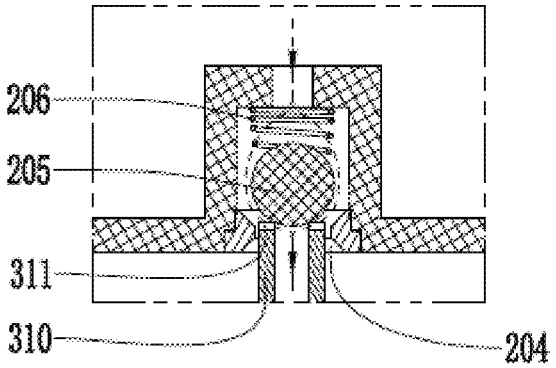
FIG. 7 is a schematic view in a case where the water outlet in FIG. 6 is opened.

In addition, as shown in FIG. 5 and FIG. 7, a tube 310 extends upwards from the water delivery hole of the controllable water valve 300, and a radial slot 311 is formed in an upper end of the tube 210. As shown in FIG. 6 and FIG. 7, a water outlet 204 connected with the water delivery hole 301 is formed in the bottom of the water tank, a valve ball 205 is arranged in the water outlet, and as shown in FIG. 6, the valve ball 205 seals the water outlet 204 under the action of an elastic force from a third spring 206 to prevent water from flowing out of the water tank. When the water tank 200, as shown in FIG. 5, is placed at the retaining position 104 to be combined with the main body 100, the tube 310 is inserted into the water outlet 204 to eject the valve ball 205 upwards, and then water can flow from the water tank into the water delivery hole along the path indicated by the dotted line with an arrow in FIG. 7. Similar to Embodiment 1, water flowing into the water delivery hole from the water tank will still be controlled by the controllable water valve, and detailed will not be repeated here. In this way, the water outlet is opened when connected with the water delivery hole and is closed when separated from the water delivery hole.

Further, in this embodiment, because the push button is arranged at the top of the water tank and occupies the position of the water filling hole in Embodiment 1, the water filling hole 201 is formed in an upper portion of the water tank and located above the handle 101 to be used for filling water into the water tank.

In other embodiments, the water outlet 204, the valve ball 205 and the third spring 206 rested on the valve ball may be arranged on a cover, a water inlet is formed in the bottom of the water tank, and the cover is threadedly assembled at the water inlet of the water tank like a cap threadedly connected with an opening of a bottle. After the cover is removed, water can be filled into the water tank via the inlet, so the water filling hole can be eliminated in this case.

Other structures of this embodiments are identical with those of Embodiment 1 and thus will not be repeated anymore.

What is claimed is:

1. An anti-scald trickling clothes steamer, comprising:

a main body placed upright;

a water tank arranged on the main body and forming a combination together with the main body;

an atomizing device located in the main body, connected with the water tank, and receiving water automatically trickling from the water tank by means of a difference in water level;

a steam pipe connected with the atomizing device, used for discharging steam generated by the atomizing device, arranged on the main body and extending upwards from the atomizing device to ensure that an outlet of the steam pipe is higher than the atomizing device; and a handle arranged on the combination and used for holding the trickling clothes steamer, wherein the handle and the outlet of the steam pipe are located on left and right sides of the trickling clothes steamer separately, wherein a controllable water valve is arranged between the water tank and the atomizing device, wherein the controllable water valve comprises a water delivery hole, a valve plug, a bimetal sheet and a wall, the water delivery hole is formed in the wall, wherein the atomizing device is located below the water tank, the atomizing device is connected with the controllable water valve to receive water from the water tank, wherein a bottom cover is arranged on a lower side of the wall, the valve plug is arranged on the bottom cover through an elastic portion and seals the water delivery hole by means of the elastic portion, wherein the elastic portion is integrated with the bottom cover and the valve plug, the valve plug and the elastic portion are made from silicone, and wherein the valve plug is provided with a shaft, the shaft is located at the water delivery hole and connected with the elastic portion.

2. The anti-scald trickling clothes steamer according to claim 1, the valve plug is arranged at the water delivery hole, and the bimetal sheet is arranged next to the valve plug and configured to deform with the change of a degree of being heated to promote the valve plug to change its position to open or close the water delivery hole.

3. The anti-scald trickling clothes steamer according to claim 2, wherein the valve plug is provided with a sealing cover connected with the shaft, the shaft is located at the water delivery hole, the sealing cover is located at an opening of the water delivery hole, and the sealing cover is able to cover the opening of the water delivery hole to close the water delivery hole and leave the opening of the water delivery hole to open the water delivery hole.

4. The anti-scald trickling clothes steamer according to claim 2, wherein the bimetal sheet is configured to receive heat from the atomizing device and open the water delivery hole when the degree of being heated is increased.

5. The anti-scald trickling clothes steamer according to claim 2, wherein the controllable water valve comprises the wall, the bottom cover is arranged on a lower side of the wall, the valve plug is arranged on the bottom cover through the elastic portion and seals the water delivery hole by means of the elastic portion, and the bimetal sheet is configured to overcome an elastic force from the elastic portion to open the water delivery hole.

6. The anti-scald trickling clothes steamer according to claim 5, wherein a channel is formed between the wall and the bottom cover, and the channel is connected with the water delivery hole and the atomizing device.

7. The anti-scald trickling clothes steamer according to claim 6, wherein a controllable flow control lever is configured for the channel.

8. The anti-scald trickling clothes steamer according to claim 5, wherein a bottom wall of the water tank functions as the wall.

9. The anti-scald trickling clothes steamer according to claim 1, wherein the water tank is fixed in the main body, a water filling hole is formed in a top of the water tank, and a water tank cover is arranged over the water filling hole.

10. The anti-scald trickling clothes steamer according to claim 9, wherein a balance hole is formed in the water tank cover.

11. The anti-scald trickling clothes steamer according to claim 9, wherein a sealing element is arranged at the water filling hole of the water tank, and when covering the water filling hole, the water tank cover is in contact with the sealing element to prevent water from leaking via the water filling hole.

12. The anti-scald trickling clothes steamer according to claim 5, wherein the wall is arranged on the main body, a water outlet connected with the water delivery hole is formed in a bottom of the water tank, and the water outlet is configured to be opened when connected with the water delivery hole and be closed when separated from the water delivery hole.

13. The anti-scald trickling clothes steamer according to claim 1, wherein the water tank is detachably arranged on the main body.

14. The anti-scald trickling clothes steamer according to claim 13, wherein the water tank and the body form a combination by means of a combining mechanism, and the combining mechanism comprises a magnetic structure and/or a lock structure.

15. The anti-scald trickling clothes steamer according to claim 1, wherein the handle is arranged on the main body or the water tank.

16. The anti-scald trickling clothes steamer according to claim 1, wherein the main body is provided with a nozzle located at a top of the main body, and the outlet of the steam pipe is extended to the nozzle.

17. The anti-scald trickling clothes steamer according to claim 16, wherein a steam panel is arranged at the outlet of the steam pipe, and a steam outlet is formed in the steam panel.

* * * * *